US007963010B2

(12) United States Patent
Levesque

(10) Patent No.: US 7,963,010 B2
(45) Date of Patent: Jun. 21, 2011

(54) TOWEL / FABRIC CLIP

(76) Inventor: Alfred B Levesque, Denver, CO (US)

( * ) Notice: Subject to any disclaimer, the term of this patent is extended or adjusted under 35 U.S.C. 154(b) by 0 days.

(21) Appl. No.: 10/000,360

(22) Filed: Dec. 4, 2001

(65) Prior Publication Data

US 2003/0101551 A1 Jun. 5, 2003

(51) Int. Cl.
*A44B 21/00* (2006.01)

(52) U.S. Cl. ..... 24/545; 24/561; 24/570; 24/3.12; 24/3.1

(58) Field of Classification Search ..... 24/543, 24/545, 546, 326, 3.1, 3.12, 563, 564, 570, 24/561

See application file for complete search history.

(56) References Cited

U.S. PATENT DOCUMENTS

| | | | | | |
|---|---|---|---|---|---|
| 252,430 | A * | 1/1882 | Cohen | ..... | 24/346 |
| 1,600,684 | A * | 9/1926 | McGibbon | ..... | 24/543 |
| 1,675,806 | A * | 7/1928 | Holden | ..... | 24/561 |
| 2,960,742 | A * | 11/1960 | Solomon | ..... | 24/561 |
| 3,766,613 | A * | 10/1973 | Merfeld | ..... | 24/561 |
| 4,773,132 | A * | 9/1988 | Eckels | ..... | 24/545 |
| 6,457,218 | B1 * | 10/2002 | Lawrence | ..... | 24/563 |

* cited by examiner

*Primary Examiner* — Robert J. Sandy

(57) ABSTRACT

A molded, semi ridged device for the purpose of securing a length of fabric or towel wrapped around the body of a person of the type having a straight flat base (10) connected to the face (12) by the top section (21). The base can be offset from the face to the left (7), right (13), and bottom (9) making the device easy to install beneath the bottom layer of the towel or fabric. The face of the device is inclined toward the base a few degree's from parallel till the beginning of the raised lip (14) which than is raised away from the base a few degree's from parallel to help facilitate the installation process. The towel/fabric clip has raise rails (15) (16) running vertically under the face, and raised rails (17) (18) running vertically under the base of the device to insure horizontal and vertical pressure on the towel/fabric.

8 Claims, 5 Drawing Sheets

TOWEL / FABRIC CLIP

BACKGROUND

1. Field of Invention

This invention relates to a molded clip of plastic, metal, or wood to securely fasten a bath towel or fabric wrapped around the waist or body of a person.

2. Objects and Advantages

Several of the objects and advantages of the present invention are:

(a) To provide a towel/fabric clip that can be manufactured in a variety of materials allowing the bather freedom of movement not readily available with the familiar tucking in of the top layer of a towel or fabric between the bottom layer and the body.

(b) To provide a towel clip that can be manufactured in a user friendly, left hand, right hand, or universal design.

(c) To provide a towel clip that will present a superior surface for the reception of personalized labeling, or of company logos either molded into, or printed onto.

(d) To provide a towel clip with molded vertical grips on the inside that will allow the user to easily slide the clip down over the layered towel/fabric providing horizontal and vertical resistance of the towel or fabric.

DRAWING FIGURES

Figure 1:
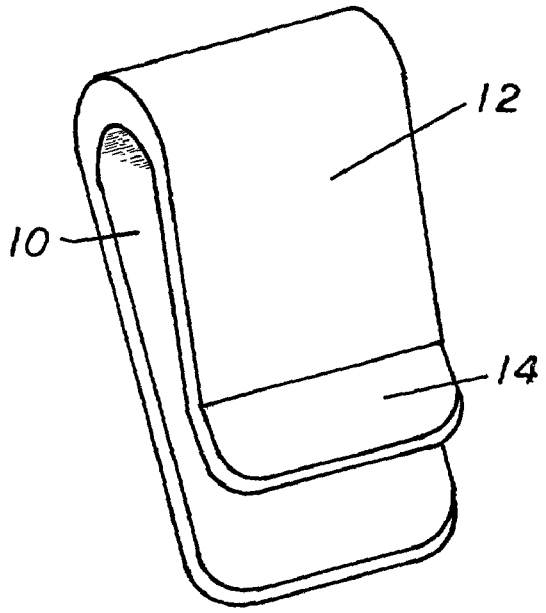
Figure 2:
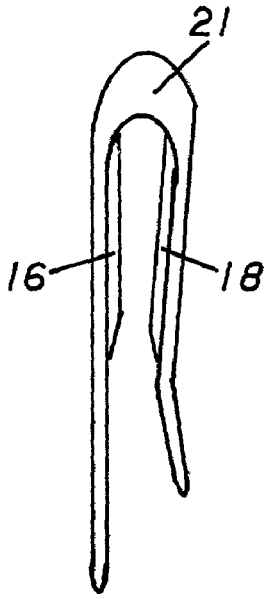
Figure 3:
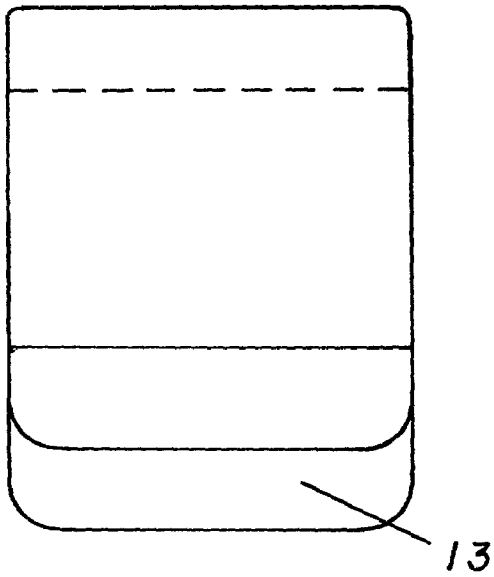
Figure 4:
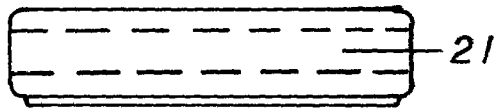
Figure 5:
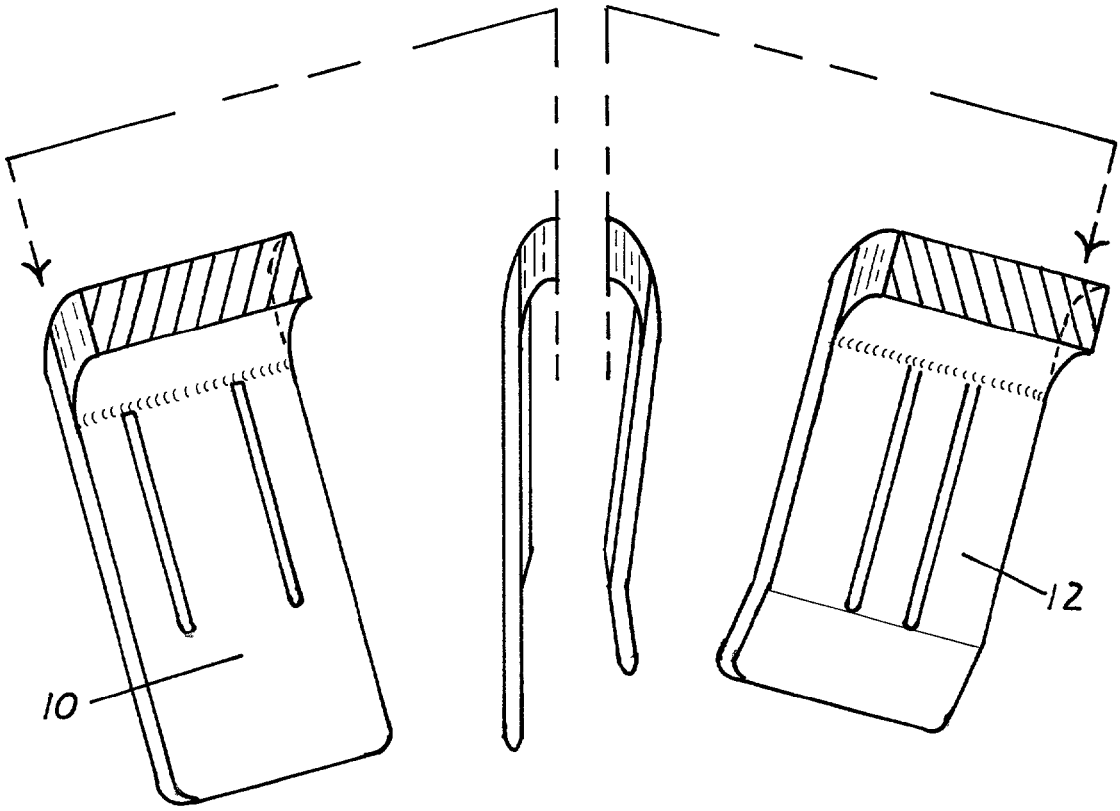
Figure 6:
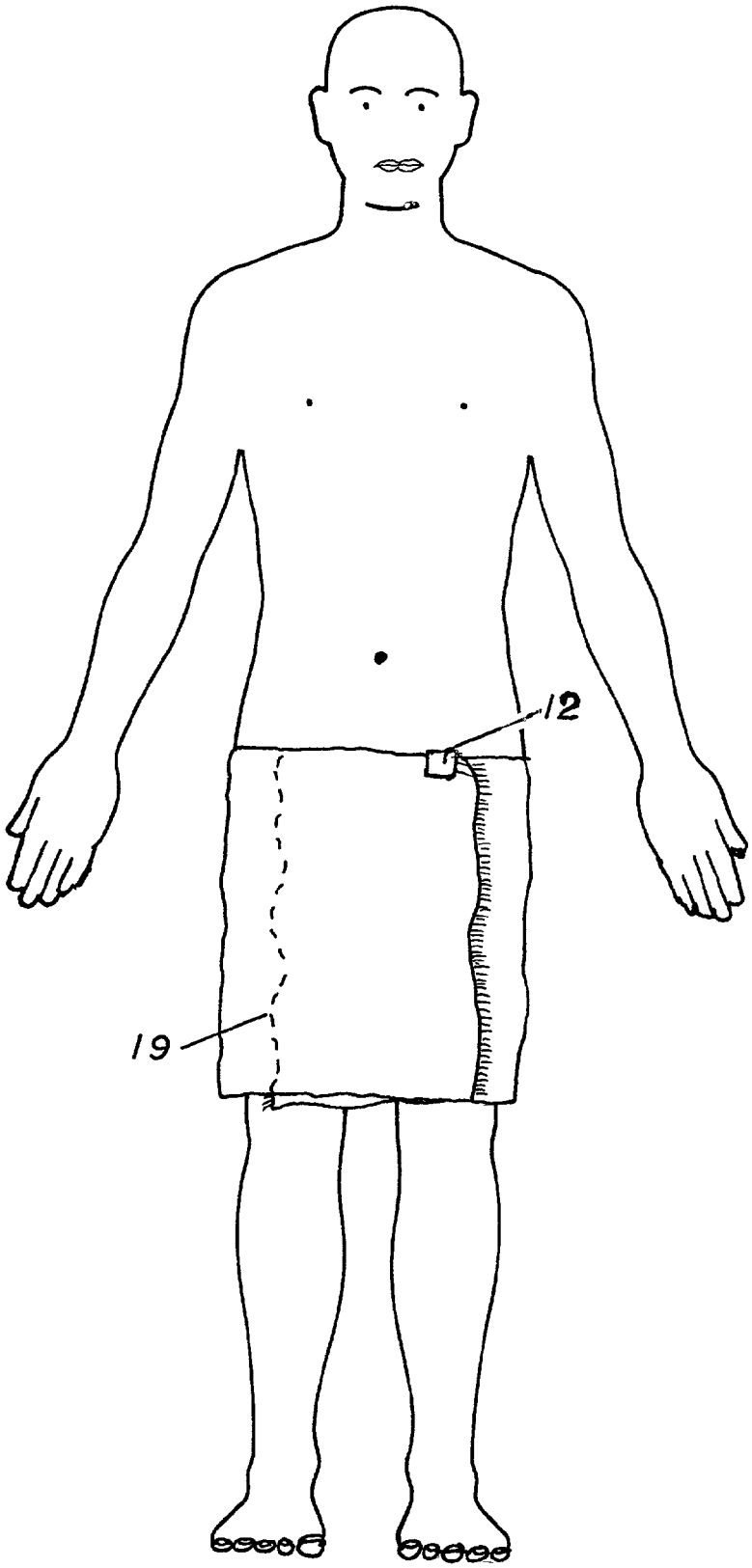
Figure 7:
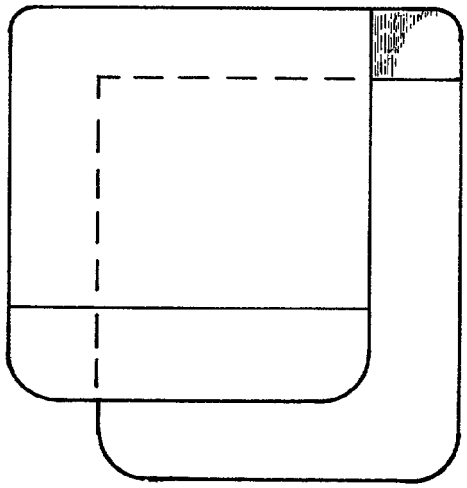
Figure 9:
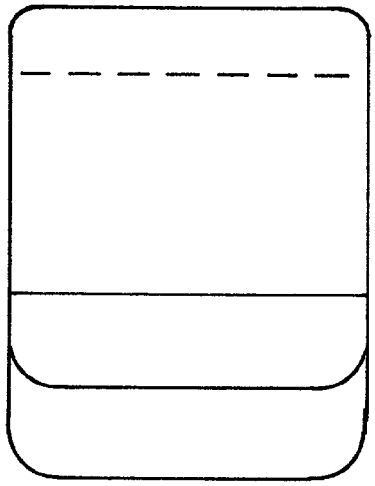
Figure 10:
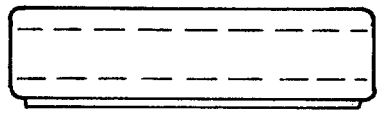
Figure 11:
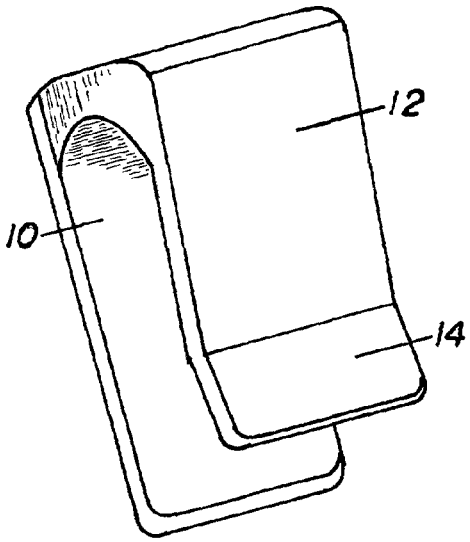
Figure 12:
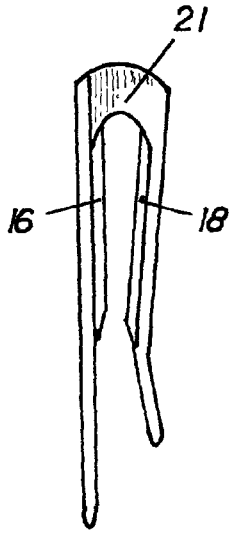
Figure 13:
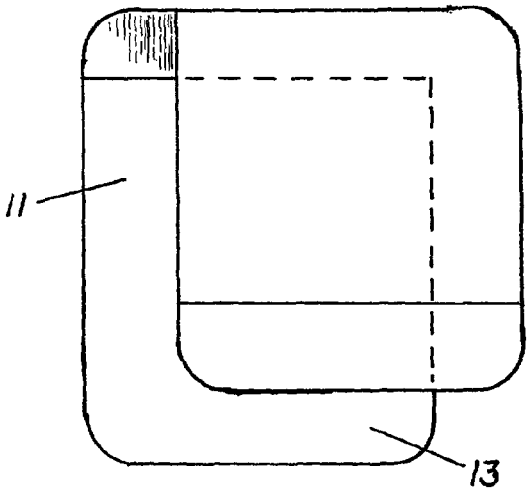
Figure 14:
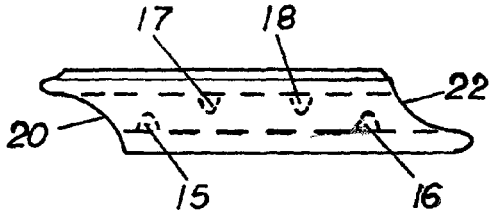

FIG. 1. Orthogonal view.
FIG. 2. Side view illustration.
FIG. 3. Front view illustration.
FIG. 4. Top view illustration.
FIG. 5. Cut view illustration of inside structure of the clip with vertical indentions/groves.
FIG. 6. Example of the clip in service on the body.
FIG. 7. Front view of left hand clip
FIG. 8. Top view of left hand clip
FIG. 9. Front view of universal clip.
FIG. 10. Top view of universal clip.
FIG. 11. Orthogonal view of right hand clip.
FIG. 12. Side view of right hand clip.
FIG. 13. Front view of right hand clip.
FIG. 14. Top view of right hand clip w/vertical raised rails.

REFERENCE NUMERALS IN DRAWINGS

10 Base of clip.
11 Offset positioning of base and face on side of right hand clip. (see FIG. 13)
12 Face of, or front of clip.
13 Offset positioning of base and face on bottom of clip
14 Raised lip of face or front of clip.
15 One of two vertical rails on base of clip.
16 Two of two vertical rails on base of clip.
17 One of two vertical rails on top part or face of clip.
18 Two of two vertical rails on top part or face of clip.
19 Fabric/towel.
20 Contour for offset on back of a right hand clip.
21 Connecting bridge between base and face at top of clip
22 Contour for offset on front of a right hand clip.

DESCRIPTION—FIGS. 1,2,3,4—PREFERRED EMBODIMENT

A preferred embodiment of the closure of the present invention is the universal design illustrated in FIG. 1 (Orthogonal view), FIG. 2 (side view), FIG. 3 (front view), FIG. 4 (top view). The clip molded with ridged materials such as plastic consists of a straight base 10 connected to an offset face 12 by the top section 21.

The face of clip is inclined toward the base a few degree's from parallel till the beginning of the raised lip 14 which is than raised away from the base a few degree's from parallel to improve the process of feeding the layered towel/fabric into the opening of the clip, thus facilitating the different thickness' of towels/fabrics in the industry. However the clip can be molded from any other material (wood, rubber, metal, fibrous materials, various plasticized materials, etc.) which can be repeatedly flexed without fracturing. The clip has raised rails 15, 16 running vertically, just short of the lip 14 on the inside of the base, and raised rails 17, 18 running vertically, just short of the lip 14 on the inside of the face/front of the clip (see FIG. 2). The approximate overall dimensions of the right hand clip in FIG. 3 are roughly 2¾" top to bottom, and roughly 2" left to right. The approximate thickness in FIG. 2 at the top to bottom of the inside of clip is roughly ⅜".

FIGS. 7-8 ADDITIONAL EMBODIMENTS

Figure 8:
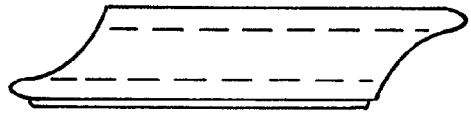

Additional embodiments as shown in FIGS. 7-8 show the towel clip designed in a left hand configuration, and FIGS. 11, 12, 13, 14, shows the towel clip designed in a right hand configuration. The face of the towel/fabric clip can be designed in an array of different shapes and sizes, ex. animals, insects, animated characters, numbers, letters, etc. depending on the desire of the customer.

FIGS. 5,12,14—ALTERNATIVE EMBODIMENTS

Due to the wide range of thickness available in the fabric industry, there are various possibilities with regard to the relative disposition of vertical rails used for horizontal resistance built into the inside of the towel/fabric clip. The clip can be manufactured with or without raise vertical rails in a variety of shapes (ex.) squared or rounded tops. In some instance's, vertical indentions/groves can be molded into the inside of base 10 and the face 12 to allow for even greater thick ness's of fabric.

ADVANTAGES

From the description above, a number of advantages of my towel/fabric clip become evident:

(a) The towel/fabric clip can be manufactured from a variety of different ridged materials such as plastic, metal or wood, according to the desire of the customer.

(b) The towel/fabric clip can be manufactured in a user friendly, right hand, universal and left hand design.

(c) The surface provides a good base for advertising personal labels or company logos.

(d) The molded vertical raised rails will allow the user to easily slide the clip down over the layered towel or fabric. The resistance will keep the towel or fabric from pulling loose giving the user a greater freedom of movement without the loss of privacy usually experience using the traditional method of tucking in the top layer of a towel or fabric between the bottom layer and body.

OPERATION—FIGS. 1,7,8

The manner of using the towel/fabric clip to secure a towel or fabric wrapped around the body is identical to the present format except that folding the top layer under the bottom layer is unnecessary. Simply wrap the towel or fabric around the body so that the top layer and the bottom layer are positioned evenly on top of each other. Hold the layered towel or fabric with one hand to the body while holding the Towel/Fabric clip in the other hand. Install the clip base beneath the bottom layer, of towel or fabric, with the clip face over the top layer of the towel/fabric near the end of the top layer.

CONCLUSION, RAMIFICATIONS, AND SCOPE

Accordingly, the reader can see that the towel/fabric clip fastener of this invention can be used to secure a towel or fabric wrapped around the body of a person, without damage to the towel or fabric. The towel/fabric clip with the raised vertical rails molded to the inside of both the base and face of the clip will insure the user against unexpected exposure at inconvenient times, and save undue embarrassment in the locker room, steam room etc.

(a) It permits the production of clips in a wide variety of ridged materials such as plastic, wood, or metal.

(b) It provides a clip that will accommodate different towel/fabric thickness' with the incorporation of raised vertical rails or vertical depressions, and their varying degree of height or depth, to facilitate thick, medium, or thin towels or fabrics.

(c) It provides a clip that can be manufactured in universal, left hand, and right hand configurations, with the face and base being offset at the bottom or sides for a more user friendly operation depending on the customers needs.

(d) The clip provides a quality surface for the incorporation of advertising company logos and personal labels.

Although the description above contains many specificities, these should not be construed as limiting the scope of the invention but as merely providing illustrations of some of the presently preferred embodiments of this invention. For example, the clip can have other shapes (square, circular, oval, triangular etc). The face of the clip can be shaped in the likeness of animals, animated characters, insects, letters, numbers, etc. Thus the scope of the invention should be determined by the appended claims and their legal equivalents, rather than by the examples given.

I claim:

1. A towel and fabric clip comprising:

a base member having a proximal end and a distal end longitudinally spaced from the proximal end of the base member along a longitudinal direction of the clip;

a front member having a proximal end and a distal end portion longitudinally spaced from the proximal end of the front member along the longitudinal direction of the clip; and a bridge portion integrally connecting to each of the proximal ends of the base member and the front member, and the bridge portion having two lateral end surfaces laterally spaced from one another along a width direction of the clip for laterally offsetting the front member from the base member along the width direction of the clip, the width direction of the clip being perpendicular to the longitudinal direction of the clip.

2. The clip of claim 1, wherein an inner side surface of each of the base member and the front member includes raised rails for providing a resistance in the longitudinal direction and width direction of the clip thereby preventing unsecurement of layered fabrics of greater thicknesses when the fabrics are secured between the base and front members.

3. The clip of claim 1, wherein the length of the base member in the longitudinal direction of the clip is greater than the length of the front member in the longitudinal direction of the clip for allowing the clip to easily slide over layered fabrics.

4. The clip of claim 3, further comprising wherein the distal end portion of the front member includes a raised lip extending away from the base member for allowing the clip to easily slide over layered fabrics.

5. The clip of claim 1, wherein the width direction of the clip includes a right-hand direction and a left hand direction opposite to the right-hand direction, and the front member is laterally offset along one of the right-hand direction and the left-hand direction, for providing the clip in one of a right-hand design and a left hand design.

6. The clip of claim 1, wherein the front member and the base member are not parallel to each other.

7. The clip of claim 1, wherein the distal end portion of the front member includes a raised lip extending away from the base member for allowing the clip to easily slide over layered fabrics.

8. The clip of claim 1, wherein the lateral end surfaces have a curved contour.

* * * * *